US008032040B2

(12) United States Patent
Lee

(10) Patent No.: US 8,032,040 B2
(45) Date of Patent: Oct. 4, 2011

(54) IMAGE FORMING APPARATUS AND METHOD THEREOF

(75) Inventor: Sun-woo Lee, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 558 days.

(21) Appl. No.: 11/971,340

(22) Filed: Jan. 9, 2008

(65) Prior Publication Data

US 2008/0317485 A1 Dec. 25, 2008

(30) Foreign Application Priority Data

Jun. 21, 2007 (KR) ..... 10-2007-0061115

(51) Int. Cl.
*G03G 15/00* (2006.01)

(52) U.S. Cl. ..... 399/45

(58) Field of Classification Search ..... 399/45, 399/66, 390, 315

See application file for complete search history.

(56) References Cited

U.S. PATENT DOCUMENTS

| | | | | |
|---|---|---|---|---|
| 5,608,506 | A * | 3/1997 | Omoto | 399/315 |
| 6,253,037 | B1 * | 6/2001 | Park | 399/44 |
| 2003/0118359 | A1 * | 6/2003 | Ogiyama et al. | 399/45 |
| 2004/0037588 | A1 * | 2/2004 | Iida | 399/124 |
| 2005/0254845 | A1 * | 11/2005 | Taki et al. | 399/45 |
| 2006/0198668 | A1 * | 9/2006 | Tsujita | 399/315 |

* cited by examiner

*Primary Examiner* — David Porta
*Assistant Examiner* — Marcus Taningco
(74) *Attorney, Agent, or Firm* — Stanzione & Kim, LLP

(57) ABSTRACT

An image forming apparatus includes a static electricity eliminator to remove residual charge from a printing medium. A selector is provided to connect the static electricity eliminator to ground through a selected resistance, and a controller is provided to control the selector depending on printing medium characteristics. The resistance in the ground path connected to the static electricity eliminator is changed according to printing medium characteristics such that elimination of residual charge is effective over a range of printing media having different printing medium characteristics.

28 Claims, 5 Drawing Sheets

IMAGE FORMING APPARATUS AND METHOD THEREOF

CROSS-REFERENCE TO RELATED APPLICATIONS

This application claims priority under 35 U.S.C. §119 (a) from Korean Patent Application No. 10-2007-0061115, filed on Jun. 21, 2007, in the Korean Intellectual Property Office, the disclosure of which is incorporated herein by reference in its entirety.

BACKGROUND OF THE INVENTION

1. Field of the Invention

The present general inventive concept relates to an image forming apparatus and a method thereof. More particularly, the present general inventive concept relates to an image forming apparatus and concomitant method in which different path resistances are selected according to printing media so that residual charge is properly eliminated from a printing medium.

2. Description of the Related Art

Various types of image forming apparatuses are available, and are mainly categorized by printing method as a dot printer, an inkjet printer, and a laser printer. Laser printers are generally considered to be superior to dot printers and inkjet printers due to their faster printing speed and better printing quality. Therefore, image forming apparatuses applying a laser printing method are widely used.

An image forming apparatus using the laser printing method generally operates through the operations of primary charge, exposure, development, transferring, and fusing. In the primary charge operation, a negative charge is applied to a surface of an organic photo conductive unit (OPC). The charge on the OPC may be locally altered by an application of light, and, in the exposure operation, a latent image is written to the OPC, which may define a surface of a drum, via a laser beam from a laser scanning unit (LSU). In the development operation, a charged toner is affixed to the latent image to develop a visual image. In the transferring operation, the toner image is transferred to a printing medium, and, in the fusing operation, the toner image is bonded to the printing medium by heat and pressure. The printing operation is then complete.

In the transferring operation, a printing medium retains charge from a transfer voltage and passes through a nip between a transfer-charging roller and an OPC, and a gap is generated between the OPC and the printing medium. The toner jumps the gap through a potential difference between the OPC and the printing medium. If a subsequent transfer operation is to be performed on the same printing medium, excessive charge thereon may, along with other problems occurring from excessive static charge accumulating between charged surfaces, prevent the proper transfer of toner in the subsequent image transfer process such that a color image of low toner density results.

A static electricity eliminator is used to prevent the foregoing problems. The static electricity eliminator removes the residual charge from the printing medium. Generally, if an image is printed in low moisture conditions, on a printing medium of high resistance composition, or on both sides of a printing medium, the printing medium presents a high resistance between the transfer-charging roller and the OPC. As a result, charge on the transfer-charging roller applied to attract toner to the latent image may be leaked as a current to the static electricity eliminator through a transfer belt.

An image forming apparatus having a resistor between a static electricity eliminator and a ground has been suggested to alleviate the transfer current leakage problems. FIG. 1 is a schematic diagram illustrating an interior of such an image forming apparatus to perform static electricity elimination.

Referring to FIG. 1, a conventional image forming apparatus comprises an organic photo conductive unit (OPC) 10, a transfer roller 20, a static electricity eliminator 30, a resistor 40, a driving roller 50, and a transfer belt 60. The image forming apparatus charges the transfer-charging roller 20 when a printing medium is transferred thereto on the transfer belt 60 as driven by a driving roller 50. A current flowing to the transfer-charging roller 20 charges the printing medium to attract toner on the OPC 10. However, when the printing medium presents a high resistance in the charge transfer path, the current that would normally flow to charge the printing is diverted across the transfer belt to the static electricity eliminator 30. If the static electricity eliminator 30 is grounded through the resistor 40, the path of least resistance will be into the printing medium. By way of the resistor 40, the image forming apparatus prevents current from leaking through the transfer belt 50.

Accordingly, better static electricity elimination is provided since charge carried over the transfer belt 50 is prevented from interfering with the operation of the static electricity eliminator 30, particularly when images are printed on the printing media having high resistance, or on the both sides of a printing medium. However, resistance between the static electricity eliminator and ground hinders current from flowing, and when images are printed on general purpose paper or on a single side of a printing medium, the added resistance to ground is not needed to prevent the leakage current across the transfer belt 60. Consequently, the conventional image forming apparatus has a problem that residual charge is not completely eliminated in low resistance printing medium situations.

As explained above, the operation of a static electricity eliminator and printing quality are influenced by the resistance and condition of the printing medium. Additionally, limited operations are provided to a user, because of limited compatibly of certain printing operations and image forming apparatuses with certain paper types.

SUMMARY OF THE INVENTION

The present general inventive concept provides an image forming apparatus to improve printing quality in which characteristics of a current path to ground from a static electricity eliminator, such as resistance, is changed according to printing medium characteristics. Thus, elimination of residual charge from a printing medium is effectively achieved for various paper types and printing methods.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus including a static electricity eliminator to remove electrostatic charge from a printing medium, a selector to selectively connect the static electricity eliminator to a ground through a first resistor or a second resistor, and a controller to control the selector according to at least one characteristic of the printing medium.

The selector may comprise a first connection line which connects the static electricity eliminator with the ground through the first resistor, and a second connection line which connects the static electricity eliminator with the ground through the second resistor, and the selector may select either the first connection line or the second connection line.

The controller may determine the printing medium characteristic as a high resistance printing medium and a low resistance printing medium according to a printing medium type or a printing manner.

The controller may determine the printing medium characteristics from a set value of a predefined printing option.

The controller may determine whether at least one of a printing medium option is set to a high resistance medium value and a simplex/duplex printing option is set to a duplex printing value, and upon a positive determination thereof, the controller may control the selector to select a resistor having a highest resistance from among the first and second resistors.

The controller may determine whether both a printing medium option is set to a general purpose printing medium value and a simplex/duplex printing option is set to a simplex printing value, and upon a positive determination thereof, and may control the selector to select a resistor having a lowest resistance from among the first and second resistors.

The controller may determine the printing medium characteristic from a current flowing through the static electricity eliminator, and may control the selector depending on the printing medium characteristic.

The controller may measure resistance of the printing medium between a resistance measuring roller and a driving roller, may determine the printing medium characteristics according to the measured resistance, and may control the selector according to the determined printing medium characteristic.

The foregoing and/or other aspects and utilities of the present general inventive concept may also be achieved by providing an image forming method including determining at least one printing medium characteristic, selecting an electrical current conduction path from a static electricity eliminator to a ground through one of a plurality of resistors according to the printing medium characteristic, and removing electrostatic charge from a printing medium having the determined printing medium characteristic with the static electricity eliminator connected to ground through the selected conduction path.

The printing medium characteristic may indicate a high resistance printing medium or a low resistance printing medium according to a printing medium type or a printing manner.

The determining may determine the printing medium characteristic from a set value of a predefined printing option.

If at least one of a high resistance printing medium option and a duplex printing option is set as a printing option, the selecting may select a resistor having high resistance from among the resistors.

If a general purpose printing medium option and a simplex printing option are set as printing options, the selecting may select a resistor having low resistance from among the resistors.

The determining may include measuring resistance of the printing medium, and determine the printing medium characteristics according to the measured resistance.

The determining may include measuring a current flowing through the static electricity eliminator, and determine the printing medium characteristics according to the measured current.

The foregoing and/or additional aspects and utilities of the present general inventive concept may also be achieved by providing an image forming apparatus including a transfer belt to transfer a printing medium to a transfer stage to receive an electrostatic charge thereat, a static electricity eliminator to direct at least a portion of the electrostatic charge to a ground, and a controller to select one of a plurality of ground paths from the static electricity eliminator to the ground according to a detected leakage current in the transfer belt.

The foregoing and/or additional aspects and utilities of the present general inventive concept may also be achieved by providing a static electricity elimination method of an image forming apparatus including determining an amount of a leakage current in a transfer belt of the image forming apparatus, and selecting one of a plurality of paths to connect a static electricity eliminator to a ground according to the determined amount of the leakage current.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
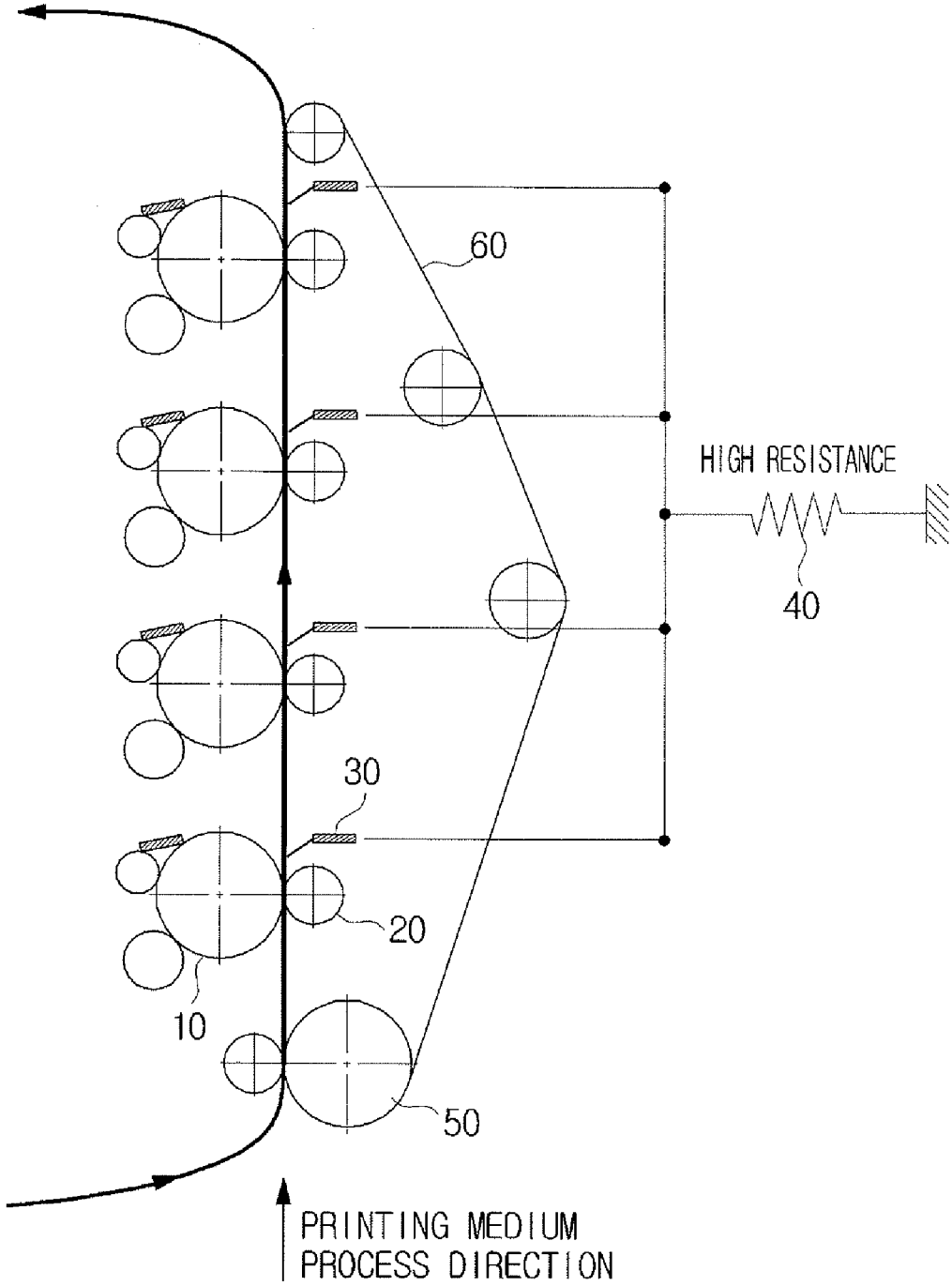
FIG. 1 (RELATED ART)
FIG. 1 is a schematic diagram illustrating an interior of a conventional image forming apparatus to perform static electricity elimination.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
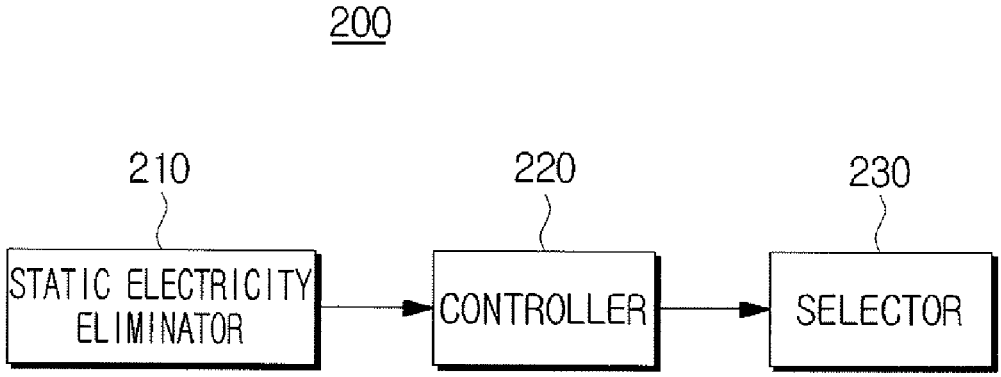
FIG. 2 is a block diagram of an image forming apparatus to improve static electricity elimination according to an exemplary embodiment of the present general inventive concept.

FIG. 2 is a block diagram of an image forming apparatus to improve static electricity elimination according to an exemplary embodiment of the present general inventive concept. Referring to FIG. 2, an image forming apparatus 200 may comprise a static electricity eliminator 210, a controller 220, and a selector 230.

The static electricity eliminator 210 may be disposed at a nip between a transfer device and a printing medium to remove electrostatic charge.

The selector 230 establishes a connection between the static electricity eliminator 210 and ground through a plurality of selectable resistances. For example, the selector 230 may select between a first resistor and a second resistor to establish the resistance between the static electricity eliminator 210 and ground. The first resistor may have a high resistance value, and the second resistor may have a low resistance value, to include 0 Ω. For example, if the selector 230 selects the second resistor, the static electricity eliminator 210 may be directly connected to ground.

The selector 230 may comprise a plurality of resistors respectively coupled to a plurality of connection lines through which the different resistance values may be selected. For example, the selector 230 may comprise a first connection terminal which directly connects the static electricity eliminator 210 to ground, and a second connection terminal which connects a resistor having high resistance between the static electricity eliminator 210 and ground.

The present general inventive concept is not limited to a particular switch mechanism to implement the selector 230. In certain embodiments of the present general inventive concept, the selector 230 uses a cam operated switch to connect the static electricity eliminator 210 to ground through a selected resistor. A cam translates translation to circular motion, or vice-versa. The controller 220 may rotate a cam to actuate a switch to provide a connection through an applicable resistor selected according to, for example, one or more characteristics of printing media or an amount of leakage current in the transfer belt.

The exemplary controller 220, among other operations, classifies a printing medium into a high resistance printing medium or a low resistance printing medium according to a printing medium type or a printing method. For example, thick paper, cotton paper, or paper undergoing duplex printing may be classified into high resistance printing media, and general purpose paper or paper undergoing simplex printing may be classified into low resistance printing media. General purpose paper may be classified as high resistance printing media when images are printed on both sides thereof since the resistance of general purpose paper increases once it passes through the fusing operation in high temperature and pressure. Thus, general purpose paper normally considered as low resistance printing media is considered by the controller 220 as high resistance printing media when it is to be printed on by a duplex printing method.

The resistance of the high resistance paper is much higher than the resistance of the general purpose paper. Consequently, if the static electricity eliminator 210 is connected to ground without a current inhibiting resistor, the current supplied to the transfer-charging roller may leak through the static electricity eliminator 210 via the transfer belt. If it is determined that the fed printing medium is a high resistance printing medium, the controller 220 may control the selector 230 to select a high resistance path from the static electricity eliminator 210 to ground. Accordingly, current supplied to the transfer-charging roller is prevented from leaking through the static electricity eliminator 210.

When general purpose paper or a simplex printing process is used, the static electricity elimination of residual charge from the printing medium is diminished if the high resistance is maintained in the current path to ground through the static eliminator 210. Accordingly, if it is determined that the printing medium is a low resistance printing medium, the controller 220 controls the selector 230 to select a low resistance path to ground, so that the residual charge is effectively removed from the printing medium.

Various methods may be implemented to classify printing media fed to an image forming apparatus according to embodiments of the present general inventive concept. Certain exemplary methods are described below, but it is to be understood that numerous other methods may be used with the present general inventive concept without departing from the spirit and intended scope thereof.

Printing medium characteristics may be determined from a setting of a predefined printing option. For example, the determination of whether a printing medium is a high resistance printing medium or a low resistance printing medium may be made by a value of a printing medium type setting or simplex/duplex option setting as set by a user. In certain embodiments of the present general inventive concept, values corresponding to frequently used low resistance printing medium types may be set as default set values without requiring setting by a user.

Printing medium characteristics may also be classified by measuring the resistance of the printing medium. For example, a test voltage may be applied across a printing medium as it is fed into a feed path of the image forming apparatus, and a resulting current may be measured. The resistance of the printing medium may be computed using the measured current. If the computed resistance is higher than a reference resistance, for example, the printing medium may be classified as a high resistance printing medium, and if the computed resistance is lower than the reference resistance, the printing medium may be classified as a low resistance printing medium.

The printing medium characteristics may be classified by measuring the current flowing through the static electricity eliminator 210. For example, it a current flowing through the path from the static electricity eliminator 210 to ground is higher than a reference current, the printing medium may be classified as a high resistance printing medium, and if the current is lower than a reference current, the printing medium may be classified as a low resistance printing medium. For example, in certain embodiments of the present general inventive concept, a current of more than 1 uA is flowing through the static electricity eliminator 210, the printing medium is classified as a high resistance printing medium, and if current less than 1 uA is flowing through the static electricity eliminator 210, the printing medium is classified as a low resistance printing medium.

In the above exemplary embodiment, the controller 220 may control the selector 230 to select resistors corresponding to the resistance of the printing medium, and/or the current in the transfer belt 60. That is, the current in the transfer belt 60, which is to be reduced or eliminated, may be determined by direct measurement thereof, or may be determined to be present when a high resistance printing medium is used for printing. Regardless of how the presence of leakage current on the transfer belt 60 is determined, the controller 220 can control the selector 230 accordingly to select the ground path resistance that reduces or eliminates the leakage current. At the same time, if it is determined that the leakage current is not flowing in the transfer belt, either by measurement or by determination through the detection of low resistance media, the controller 220 controls the selector to minimize the ground resistance accordingly so that residual charge may flow freely from the printing medium, through the static electricity eliminator 210, to ground.

Figure 3:
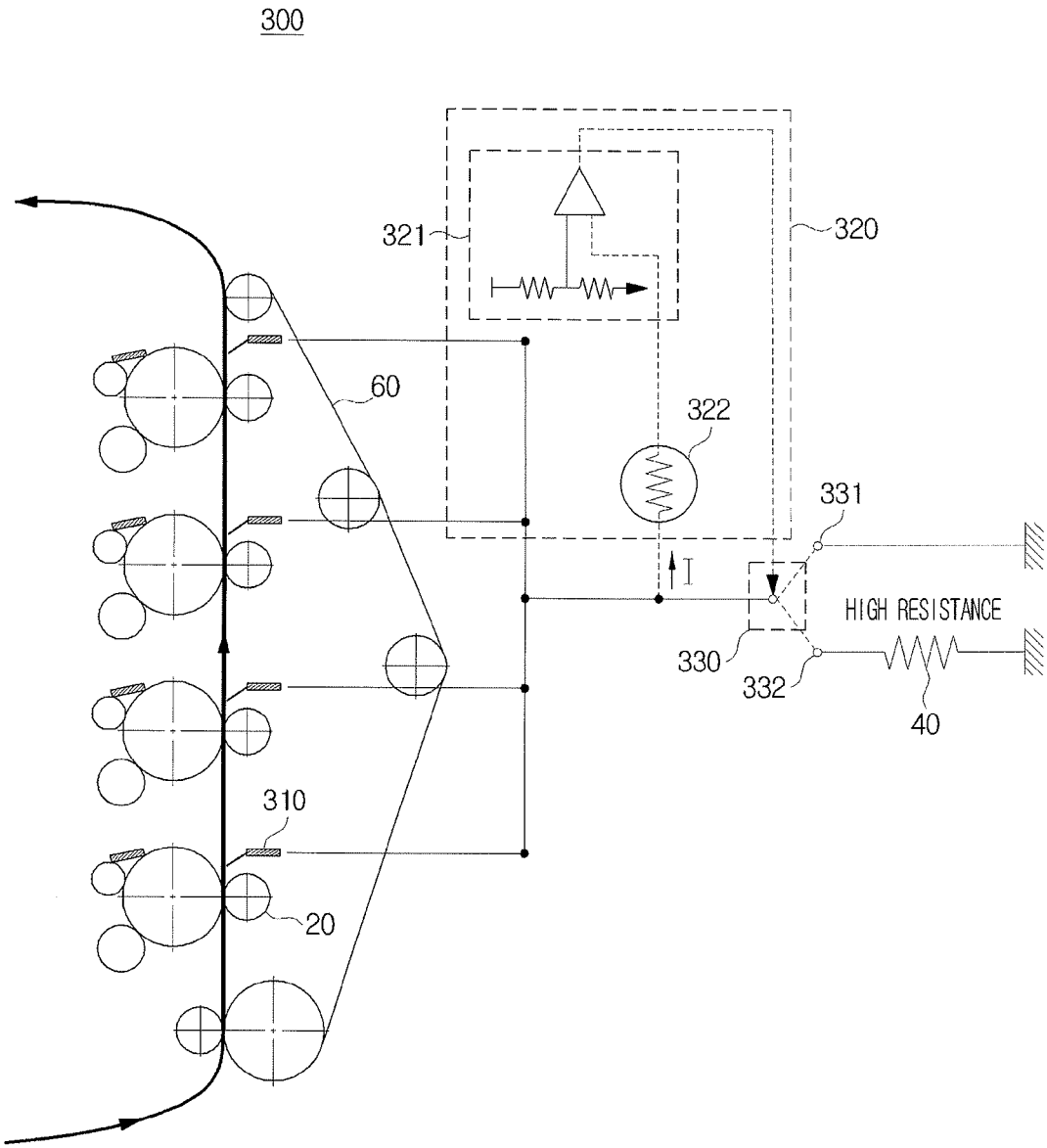
FIGS. 3 and 4 are views illustrating various examples of an image forming apparatus to perform a static electricity elimination operation according to an exemplary embodiment of the present general inventive concept.

FIG. 3 is a view illustrating the interior of an image forming apparatus to perform static electricity elimination according to an exemplary embodiment of the present general inventive concept.

Referring to FIG. 3, an image forming apparatus may comprise a static electricity eliminator 310, a controller 320, a selector 330, a comparator 321, and a reference resistor 322.

The exemplary controller 320 comprises the comparator 321, and the reference resistor 322. The comparator 321 compares a reference voltage with a voltage at the static electricity eliminator 310 to control the connection between the selector 330 and ground. The reference voltage may be properly set according to the characteristics of an image forming apparatus. For example, 1V may be used as a reference voltage.

When a printing medium is fed to the image forming apparatus, and a transfer operation is executed, a portion of the charging voltage provided on the printing medium is supplied to the static electricity eliminator 310, where the portion of the charging voltage that appears at the static electricity eliminator 310 depends on the conductivity of the transfer belt 60 and the distance between the static electricity eliminator 310 from the transfer roller 20. The exemplary comparator 321 is connected with the reference voltage, for example, 1V. The supplied voltage may be computed using the current (I) input to the controller 320 and the reference resistance 322.

The comparator 321 compares the voltage on the static electricity eliminator 310 with the reference voltage. If the voltage of the static electricity eliminator 310 is higher than the reference voltage, the selector 340 is connected with a resistor having the high resistance to ground. Therefore, the current is not leaked through the static electricity eliminator 310. On the other hand, if the voltage of the static electricity eliminator 310 is lower than the reference voltage, the selector 340 is connected to ground such that the residual charge on the printing medium flows out without hindrance.

Figure 4:
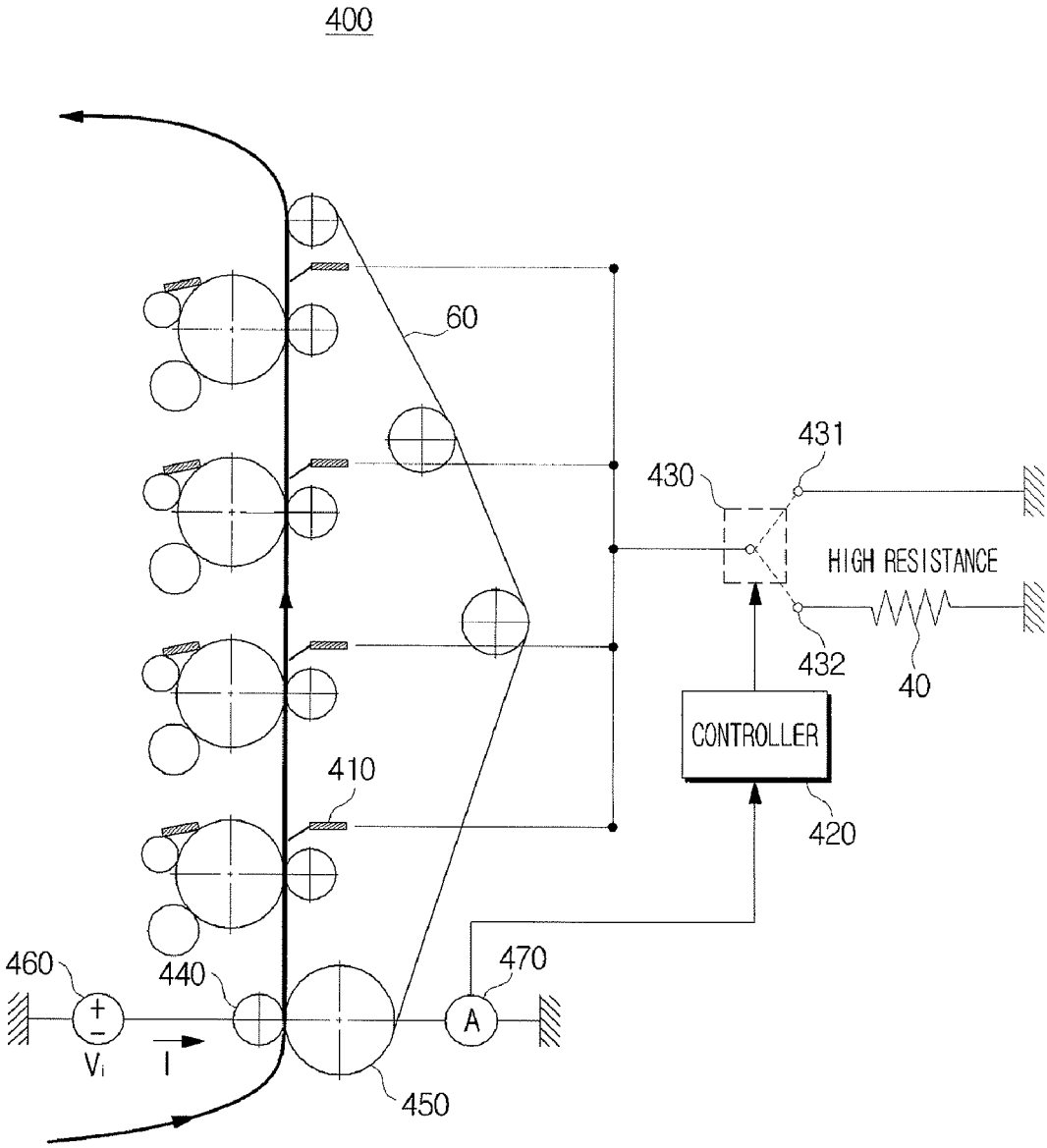

FIG. 4 is a view illustrating the interior of an image forming apparatus to perform static electricity elimination according to another exemplary embodiment of the present general inventive concept.

Referring to FIG. 4, an image forming apparatus may comprise a static electricity eliminator 410, a controller 420, a selector 430, a resistance measuring roller 440, a driving roller 450, a measured voltage supplier 460, and a current measuring device 470.

The measured voltage supplier 460 supplies a fixed test voltage to the resistance measuring roller 440.

The current measuring device 470 measures the current flowing through a printing medium that is fed between the resistance measuring roller 440 and the driving roller 450 and provides a signal indicative of the current value to controller 420.

If the printing medium is fed, the resistance measuring roller 440 receives fixed voltage (Vi) from the measured voltage supplier 460. The driving roller 450 is connected to ground through the current measuring device 470. If the printing medium is fed between the resistance measuring roller 440 and the driving roller 450, the fixed voltage (Vi) is supplied from the measured voltage supplier 460 to the driving roller 450, and the current corresponding to the resistance of the printing medium flows through the printing medium. The resistance of the printing medium may be computed using the measured current (I), the fixed voltage (Vi), and the known resistance values of the resistance measuring roller 440, the driving roller 450, and the transfer belt 60.

If the resistance of the printing medium is higher than reference resistance based on the the computed resistance, the selector 430 may be connected to ground through a resistor having high resistance. Therefore, the current is not leaked to the static electricity eliminator 410. If the resistance of the printing medium is lower than reference resistance, the selector 430 may be connected directly to ground such that the residual charge may be effectively removed from the printing medium.

The reference resistance in the exemplary embodiments of the present general inventive concept may be selected as the resistance of printing media that is beyond the printing capability of the image forming apparatus. For example, if the image forming apparatus is capable of forming satisfactory images on printing media having resistances from 1Ω to 8M Ω, the resistance of 9M Ω may be set as the reference resistance.

Two current paths 431, 432 are represented in the exemplary embodiments of the present general inventive concept, but a plurality of current paths having resistances corresponding to a range of printing media types may be provided.

Figure 5:
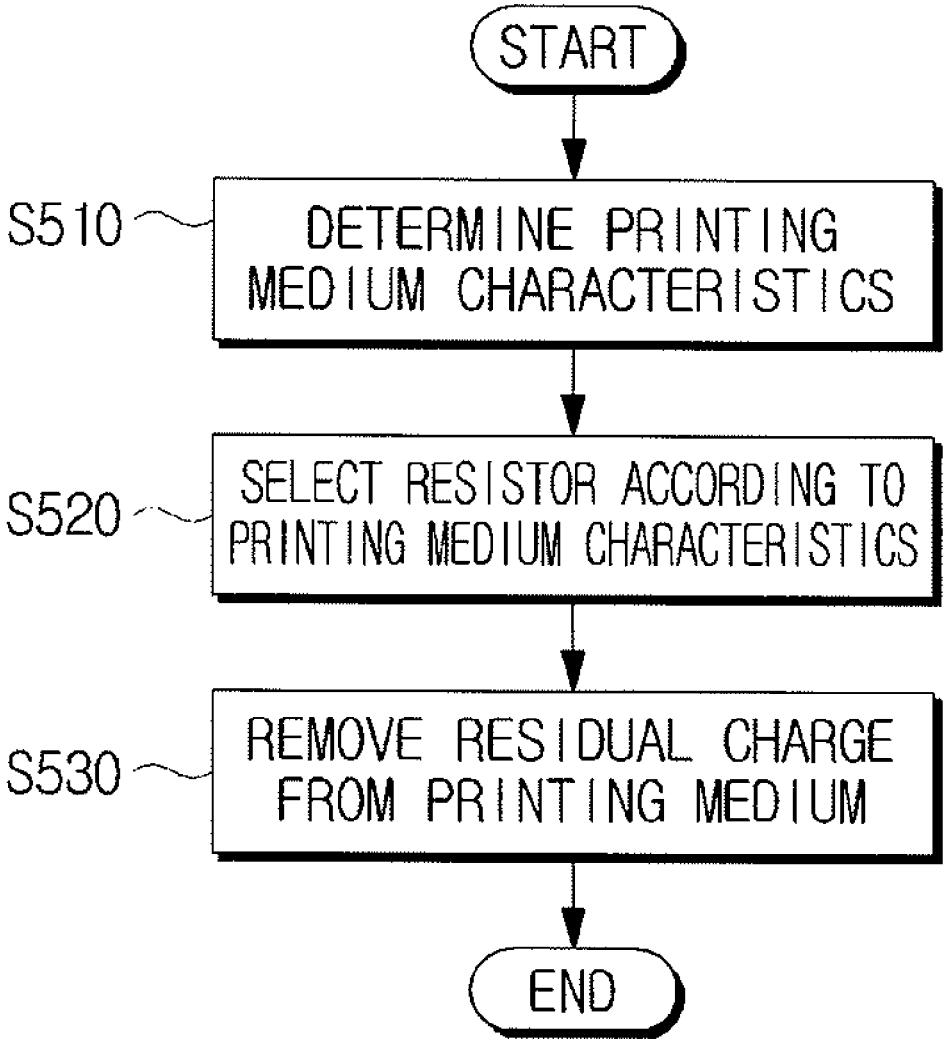
FIG. 5 is a flowchart illustrating a static electricity eliminating method of an image forming apparatus according to an exemplary embodiment of the present general inventive concept.

FIG. 5 is a flowchart to explain a static electricity eliminating method of an image forming apparatus according to an exemplary embodiment of the present general inventive concept.

Referring to FIG. 5, in operation S510, printing medium characteristics are determined.

The printing media may be classified as a high resistance printing medium or a low resistance printing medium according to a printing medium type or a printing method. The printing medium characteristics may be defined according to printing options set by a user. Alternatively, the printing medium characteristics may be determined by measuring the resistance of printing medium or by measuring the current flowing to the static electricity eliminator. Other means to determine the printing medium characteristics will be apparent to the skilled artisan upon review of this disclosure.

In operation S520, the static electricity eliminator is selectively connected to ground through one of a plurality of resistors according to the printing medium characteristics. For example, if a printing medium is a high resistance printing medium, a resistor having high resistance is selected, and is connected to the static electricity eliminator. If a printing medium is a low resistance printing medium, a resistor having low resistance is selected, and is connected to the static electricity eliminator. The static electricity eliminator may be connected directly to ground in cases where the presence of low resistance printing media is determined.

If a connection line is selected according to the printing medium characteristics, in operation S530, the residual charge is removed from the printing medium. If the printing medium is a high resistance printing medium, the static electricity eliminator is connected with a resistor having high resistance. Therefore, the leakage of current is prevented in a process of transferring.

If the printing medium is a general purpose paper, the static electricity eliminator may be connected to ground such that the charge is removed efficiently from the printing medium, and a high quality image is output. The image forming method of FIG. 5 is applicable to exemplary image forming apparatuses illustrated in FIGS. 2 to 4, and is also applicable to the other image forming apparatuses.

As described above, a ground path resistance connected to a static electricity eliminator is changed according to the presence of leakage current in the transfer belt, which can be deduced by the printing medium characteristics. If the printing medium is a high resistance printing medium, the flow of leakage of current is prevented by increasing the ground path resistance. If a general purpose paper is used, the residual charge is effectively discharged by decreasing the ground path resistance and a high quality image is thus output.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

a static electricity eliminator to remove electrostatic charge from a printing medium along a printing path;

a switch electrically connected to the static electricity eliminator wherein the switch switches to ground through either a first resistor or a second resistor along at least one location on the printing path; and a controller to control the switch according to at least one characteristic of the printing medium.

2. The apparatus of claim 1, wherein the switch comprises:

a first connection line which connects the static electricity eliminator with the ground through the first resistor; and a second connection line which connects the static electricity eliminator with the ground through the second resistor, wherein the switch switches between the first connection line or the second connection line.

3. The apparatus of claim 1, wherein the controller determines the printing medium characteristic as a high resistance printing medium or a low resistance printing medium according to a printing medium type or a printing manner.

4. The apparatus of claim 1, wherein the controller determines the printing medium characteristic from a set value of a predefined printing option.

5. The apparatus of claim 4, wherein the controller determines whether at least one of a printing medium option is set to a high resistance printing medium value and a simplex/duplex printing option is set to a duplex printing value and, upon a positive determination thereof, controls the switch to select a resistor having a highest resistance from among the first and second resistors.

6. The apparatus of claim 4, wherein the controller determines whether both a printing medium option is set to a general purpose printing medium value and a simplex/duplex printing option is set to a simplex printing value and, upon a positive determination thereof, controls the switch to select a resistor having a lowest resistance from among the first and second resistors.

7. The apparatus of claim 1, wherein the controller determines the printing medium characteristic from a current flowing through the static electricity eliminator, and controls the switch in accordance with the determined printing medium characteristic.

8. The apparatus of claim 1, wherein the controller measures a resistance of the printing medium between a resistance measuring roller and a driving roller, determines the printing medium characteristic from the measured resistance, and controls the switch according to the determined printing medium characteristic.

9. An image forming method, comprising:

determining at least one printing medium characteristic;

selecting an electrical current conduction path from at least one unitary static electricity eliminator to ground through a switch that switches between one of a plurality of resistors according to the determined printing medium characteristic; and removing electrostatic charge from a printing medium having the determined printing medium characteristic with the static electricity eliminator connected to ground through the selected current conduction path.

10. The method of claim 9, wherein the printing medium characteristic determining includes indicating the printing medium characteristic as a high resistance printing medium or a low resistance printing medium according to a printing medium type or a printing manner.

11. The method of claim 9, wherein the determining determines the printing medium characteristic from a set value of a predefined printing option.

12. The method of claim 11, wherein the conduction path selecting selects a high resistance resistor in the conduction path if the characteristic determining determines that at least one of a high resistance printing medium option and a duplex printing option is set as the printing option.

13. The method of claim 11, wherein the conduction path selecting selects a low resistance resistor in the conduction path if the characteristic determining determines that a general purpose printing medium option and a simplex printing option are set as printing options.

14. The method of claim 9, wherein the determining comprises measuring resistance of the printing medium, and determines the printing medium characteristics according to the measured resistance.

15. The method of claim 9, wherein the determining comprises measuring a current flowing through the static electricity eliminator, and determines the printing medium characteristics according to the measured current.

16. An image forming apparatus comprising:

a transfer belt to transfer a printing medium to a transfer stage to receive an electrostatic charge thereat;

a static electricity eliminator to direct at least a portion of the electrostatic charge to a ground; and a controller to select one of a plurality of ground paths from the static electricity eliminator to the ground according to a detected leakage current in the transfer belt, wherein the controller determines whether the leakage current is less than a predetermined threshold and selects the one of the ground paths that has a resistance that reduces the impedance to the ground.

17. The apparatus of claim 16, wherein the controller determines whether the leakage current is greater than a predetermined threshold and selects the one of the ground paths that has a resistance that reduces the leakage current.

18. The apparatus of claim 16, wherein the controller determines the leakage current from a measurement of current in the static electricity eliminator.

19. The apparatus of claim 16, wherein the controller detects the leakage current from a resistance of the printing medium.

20. The apparatus of claim 19 further comprising:

a printing medium resistance measuring apparatus to measure the resistance of the printing medium.

21. The apparatus of claim 19, wherein the controller determines the resistance of the printing medium from a printing medium type setting.

22. The apparatus of claim 19, wherein the controller determines the resistance of the printing medium from a printing processing setting.

23. The apparatus of claim 22, wherein the print processing setting is a simplex/duplex printing setting.

24. The apparatus of claim 16 further comprising:

a selector to connect the static electricity eliminator to the ground according to a signal from the controller, the selector including a plurality of resistors having different values and respectively connected in the ground paths.

25. A static electricity elimination method of an image forming apparatus comprising:

determining an amount of a leakage current in a transfer belt of the image forming apparatus;

selecting one of a plurality of paths to connect a static electricity eliminator to a ground according to the determined amount of the leakage current, wherein the leakage current determining includes determining whether the leakage current is less than a predetermined threshold and the selecting includes selecting the one of the ground paths that has a minimum resistance to the ground.

26. The method of claim 25, wherein the leakage current determining includes determining whether the leakage current is greater than a predetermined threshold and the selecting includes the one of the ground paths that has a resistance that reduces the leakage current.

27. The method of claim 25, wherein the leakage current determining includes measuring the leakage current through the static electricity eliminator.

28. The method of claim 25, wherein the leakage current determining includes determining a presence of the leakage current from a resistance of the printing medium.

* * * * *